US005433825A

United States Patent [19]

Minor et al.

[11] Patent Number: 5,433,825

[45] Date of Patent: * Jul. 18, 1995

[54] METHOD FOR PULPING WOOD CHIPS SEPARATE ALKALI AND PEROXYMONOSULFATE TREATMENTS

[75] Inventors: James L. Minor, Middleton; Edward L. Springer, Madison, both of Wis.

[73] Assignee: The United States of America as represented by the Secretary of Agriculture, Washington, D.C.

[ * ] Notice: The portion of the term of this patent subsequent to Apr. 2, 2008 has been disclaimed.

[21] Appl. No.: 255,153

[22] Filed: May 2, 1994

Related U.S. Application Data

[63] Continuation of Ser. No. 832,196, Feb. 6, 1992, abandoned.

[51] Int. Cl.[6] ..... D21C 3/02

[52] U.S. Cl. ..... 162/86; 162/78; 162/82; 162/90

[58] Field of Search ..... 162/82, 86, 78, 90

[56] References Cited

U.S. PATENT DOCUMENTS

| | | | |
|---|---|---|---|
| 1,773,419 | 8/1930 | Baker | 162/40 |
| 1,880,043 | 9/1932 | Richter | 162/82 |
| 2,599,572 | 6/1952 | Miller | 92/13 |
| 2,956,918 | 10/1960 | Snyder | 162/90 |
| 3,617,435 | 11/1971 | Kalish | 162/9 |
| 4,404,061 | 9/1983 | Cael | 162/76 |
| 4,475,984 | 10/1984 | Cael | 162/76 |
| 4,486,267 | 12/1984 | Prusas | 162/25 |
| 4,900,399 | 2/1990 | Bengtsson et al. | 162/26 |
| 5,002,635 | 3/1991 | Gentile, Jr. et al. | 162/78 |
| 5,004,523 | 4/1991 | Springer et al. | 162/76 |
| 5,091,054 | 2/1992 | Meier et al. | 162/76 |

OTHER PUBLICATIONS

Minor, James L. and Edward L. Springer, "Delignification of Wood Fibers w/Peroxymonosulfate", Paper & Timber 72(10), pp. 967–973 (1990).

Katz, S., "A Mechanism for the alkali strengthening of mechanical pulps," Tappi Journal, 64:97–100 (Jul. 1981).

Springer, Edward L., "Delignification of aspen wood using hydrogen peroxide and peroxymonosulfate," Tappi Journal, 73(1) pp. 174–178 (Jan. 1990).

*Primary Examiner*—Karen M. Hastings
*Assistant Examiner*—Dean T. Nguyen
*Attorney, Agent, or Firm*—Janet I. Stockhausen; M. Howard Silverstein; John D. Fado

[57] ABSTRACT

The present invention is directed to a process for pulping of lignocellulosic materials. In the process, the ligoncellulose material is impregnated with an alkaline liquor. The lignocellulose material is maintained in the alkaline liquor for a period of time sufficient to permit infusion of the alkaline liquor and swelling of the lignocellulose material. The alkaline liquor is then drained from the lignocellulose material and the lignocellulose material may be washed with water, although such washing step is not required. The alkaline impregnated lignocellulose material is then immersed in an acidic oxidizing solution comprising peroxymonosulfate anion. The lignocellulose material is maintained in the oxidizing solution for a time sufficient to oxidize at least some of the lignin of the lignocellulose material. Thereafter, a second alkaline liquor is used to solubilize the oxidized lignin.

14 Claims, No Drawings

METHOD FOR PULPING WOOD CHIPS SEPARATE ALKALI AND PEROXYMONOSULFATE TREATMENTS

This is a continuation of application Ser. No. 07/832,196, filed Feb. 6, 1992 now abandoned.

FIELD OF THE INVENTION

The present invention relates generally to a pulping process using peroxymonosulfate as the pulping chemical. More particularly, the present invention relates to a pulping process wherein a lignocellulose material is pretreated with an alkali followed by a chemical pulping treatment with peroxymonosulfate and subsequent extraction of the degraded lignin with alkali.

BACKGROUND OF THE INVENTION

Any fibrous raw material, such as wood, straw, bamboo, hemp, bagasse, sisal, flax, cotton, jute and ramie can be defibered and used in paper manufacture. Separation of the fibers of such materials is called pulping, regardless of the extent of purification involved in the process. The separated fibers are referred to as pulp, whether in suspension in water or dried to any degree. There are three principal processes for providing pulp; these being mechanical pulping, alkaline pulping and acid pulping. The principal alkaline pulping method is the Kraft process and the principal acid pulping process is the sulfite process.

Mechanical pulping was the initial process used to prepare wood pulp. In mechanical pulping, wood pulp is produced by pressing a log against a rotating grindstone or by passing woad chips or other cut-up raw materials through a refiner, which consists of counter rotating hard metal disks with grooves cut into them. Fibers separated mechanically are damaged substantially in the process and provide weaker paper. However, since such fibers retain most of the wood components, the yield of pulp per unit weight of wood is high, usually in excess of 95%.

In order to raise the quality of wood pulp, the so-called chemical methods were developed. These methods involve chipping the wood and treating the wood chips with alkaline or acidic chemicals at elevated temperatures and pressures. The lignin and part of the carbohydrates present are released during the digestion process and the pulp yield is normally about 50%. Some of the lignin is retained in the pulp, particularly in the alkaline processes, such as the Kraft process. The lignin in the pulp may be further reduced by bleaching the pulp in various sequences with chemicals such as chlorine, alkali, oxygen-gas, chlorine dioxide, hydrogen peroxide and hypochlorite to remove residual lignin and other colored impurities.

Chemical pulps have good strength properties and can have high brightness values with bleaching. These attributes, however, are obtained at the cost of low yields. This has led in recent years to development work aimed at producing mechanical pulps in high yields which have strength properties approaching those of the chemical pulps; while at the same time, retaining the opacity and bulk properties unique to the mechanical pulps. When the lignin is softened by heating the raw wood chips or other lignocelluloses with steam before and during refining under pressure, the separated fibers make significantly stronger paper than ground wood or refiner ground wood, but still weaker than chemical pulps. Such pulp is referred to as thermomechanical pulp (TMP). Still stronger pulp is obtained with somewhat lower yield by treating wood chips or other cut-up raw material with chemicals before refining. This type of pulp is called chemical thermomechanical pulp (CTMP). When larger amounts of chemicals are used, but yet insufficient to separate the fibers without refining, the pulp is called choral-mechanical pulp (CMP).

Significant developments have taken place which combine various pretreatment steps in the chemical pulping processes, whether the pulping process utilizes an alkaline material or an acid material. Thus, alkaline pretreatment prior to acid pulping is known as well as acid treatment prior to alkaline pulping.

U.S. Pat. No. 4,900,399, for example, is directed to produce chemi-mechanical pulp from lignocellulosic material wherein the material is impregnated in two stages. The lignocellulose material is first steamed and is then impregnated with an aqueous alkali. Excess unreacted alkali is removed from the chips and the chips are further impregnated with a peroxide solution. The chips are then refined by a mechanical pulping process to produce the pulp.

U.S. Pat. No. 4,404,061 to Cael describes a chemical pulping process wherein wood chips are first subjected to an acid pretreatment with potassium monopersulfate, followed by alkaline pulping by standard methods, for example, the cold soda method or Kraft process. It is indicated in the Cael patent that the pulp so produced will have a lower kappa number, lower viscosity and slightly lower yield than pulp produced from wood chips by an otherwise identical alkaline pulping process omitting the monopersulfate pretreatment.

U.S. Pat. No. 2,956,918 relates to chemi-mechanical wood pulping method wherein wood chips are pretreated with a lime slurry prior to subjecting the chips to a mechanical fiber separation operation.

U.S. Pat. No. 2,599,572 to Miller is also directed to a chemi-mechanical pulping process wherein wood chips are first impregnated with a solution of sodium hydroxide under conditions of high temperature and pressure. The sodium hydroxide solution is drained and the chips are then immersed in a water suspension of lime. The chips are cooked in the lime for a period of approximately 7 hours at approximately 250° F. to render the fibers readily separable by mechanical means. The fibers are then mechanically separated.

U.S. Pat. No. 4,486,267 to Prusas is directed to a chemi-thermomechanical pulping process employing separate alkali and sulfite treatments. In the method of the '267 patent, wood chips are first impregnated with an aqueous solution containing about 3% to 10% sodium hydroxide. The chips are maintained in the sodium hydroxide solution for a period of time sufficient to permit chemical softening of the chips. The chips are removed from the sodium hydroxide solution and are impregnated in a second impregnating step with a sulfite liquor. The sulfite liquor is an aqueous solution containing about 2% to 10% by weight sodium sulfite or sodium bisulfite. The impregnated chips are cooked in the sulfite liquor at a temperature of approximately 120° to 180° C. for a period of time sufficient to sulfonate the lignin in the chips and to soften the chips without removing substantial amounts of lignin. The wood chips are then defibrated by passing the chips through a refining apparatus.

U.S. Pat. No. 1,880,043 to Richter relates to an alkaline chemical pulping process wherein wood chips are initially treated with a solution of a mineral acid. The wood chips are treated with a solution of mineral acid and then cooked at elevated temperature and under pressure in a solution of a suitable alkali, such as the usual Kraft or soda liquors. This process produces cellulose pulps of high alpha cellulose content and of exceedingly low pentosan content.

U.S. Pat. No. 3,617,435 to Kalisch describes an acid bisulfite wood-pulping process in which the wood chips are pretreated with an alkaline solution containing not more than about 2% by weight of formaldehyde.

U.S. Pat. No. 1,773,419 to Baker is also directed to an acid bisulfite pulping process. In the Baker process, the wood chips are subjected to pretreatment with a weak alkali solution and steam so as to render the alpha lignin insoluble in the sulfite cooking step employed at a later stage of the process. An example of weak alkali solutions are solutions of caustic soda, barium hydrate and the like. The pretreatment with a weak alkali solution takes place at temperatures of 90° to 100° C. for 1 to 2 hours. It is indicated that the alkali pretreatment is preferably carried on in the presence of ammonia, which creates relatively high vapor pressures at the temperature employed and forces the weak alkali solution into the pores of the wood.

The difficulty of pretreating wood with dilute aqueous sodium hydroxide is emphasized in U.S. Pat. No. 2,956,918 to Snyder. The Snyder patent states that it is impossible to treat wood uniformly with dilute aqueous sodium hydroxide. It is stated that sodium hydroxide attacks acetyl, polyuronides, pentosans, hexosans and slowly attacks lignin. If the total quantity of sodium hydroxide present is insufficient to react with all of these components, the result is that, for the most part, the surface layers are attacked and the interior mass is hardly penetrated at all. It is further indicated in the Snyder patent, that when steeping is carried out in a 5% solution of sodium hydroxide, which is in excess of that required to react with all of the reactable constituents, the outer layers of the wood become impregnated with organic sodium compounds that are colloidal, viscous substances, rather than true solutions and these substances impede or prevent complete penetration of the chips. The Snyder patent solves these perceived problems of treatment with sodium hydroxide by using a treatment of wood chips with a mixture of lime and sodium carbonate prior to mechanical refining of the wood chips.

U.S. Pat. No. 4,475,984 to Cael is directed to an alkaline pulping process wherein the lignocellulosic materials are pretreated with monoperoxysulfate to permit more ready separation of the non-cellulosic materials during the alkaline pulping step.

The delignification of aspen wood particles by treatment with hydrogen peroxide and peroxymonosulfate is discussed in an article by Springer, Tappi Journal, 73 (1) pp. 175–178 (January, 1990). The Springer article concluded that it was possible to delignify No. 40 mesh ground aspen wood particles with solutions containing peroxymonosulfate.

In an article of Minor and Springer, "Delignification of Wood Fibers with Peroxymonosulfate", Paper and Timber, 72(10), pp. 967–973 (1990) , the use of peroxymonosulfate was investigated for the delignification of wood fibers to produce paper pulp. High lignin fibbers, such as those produced by the cold-soda process and hardboard fiber process were investigated. The hardboard fiber process produces fibers with minimal physical damage by thermal softening of the middle lamella lignin, followed by mechanical refining. The resulting lignin-coated fibers are not suitable for papermaking, but fibers are provided wherein the lignin is readily accessible to oxidative reagents in solution. Neither of the foregoing articles discloses a process for delignifying wood chips as opposed to delignification of pulp or ground wood particles.

Accordingly, it is a principal object of the present invention to provide a method for pulping of wood chips and other large lignocellulosic particles utilizing an acidic oxidizing agent comprising peroxymonosulfate.

It is another object of the present invention to provide a method for chemical pulping or chemi-mechanical pulping of lignocellulosic materials wherein the method can be practiced at relatively low temperatures and relatively low or no pressure.

These and other objects of the invention will become more apparent from the following description and the appended claims.

SUMMARY OF THE INVENTION

The present invention is directed to a process for pulping of lignocellulosic materials. In the process, the lignocellulose material is impregnated with an alkaline liquor. The lignocellulose material is maintained in the alkaline liquor for a period of time sufficient to permit infusion of the alkaline liquor and swelling of the lignocellulose material. The alkaline liquor is then drained from the lignocellulose material and the lignocellulose material may be washed with water, although such washing step is not required. The alkaline impregnated lignocellulose material is then immersed in an acidic oxidizing solution comprising peroxymonosulfate anion. The lignocellulose material is maintained in the oxidizing solution for a time sufficient to oxidize at least some of the lignin of the lignocellulose material. Thereafter, a second alkaline liquor is used to solubilize the oxidized lignin.

DETAILED DESCRIPTION OF THE INVENTION

The present invention involves soaking lignocellulosic particles in an aqueous solution of alkali prior to delignification with an acidic oxidizing solution comprising peroxymonosulfate. The lignocellulosic material may be any of the woody and non-woody fibrous plant materials, including deciduous and coniferous woods. The soaking treatment in the alkaline solution may be a simple covering of the particles with the liquid alkaline solution. Penetration of the alkaline solution may be assisted by removal of air with steam or vacuum or pressure may be applied. The temperature during the alkaline treatment step is in the range of 0° C. to 50° C.

The particles may be conventional wood chips (¼ to 1.0 inch length) , destructured or shredded wood, wood wafers (1 to 3 mm thick), match sticks, short sections of straw, kenaf or bagasse stalks or similar particles. The alkaline material may be any of the alkaline metal or alkali earth metal hydroxides or carbonates or ammonium hydroxide or an organic base. The alkaline material is selected to be capable of providing an aqueous solution having a pH higher than 11. The preferred alkaline material is sodium hydroxide. The concentration of alkali in the alkaline solution is in the range of 0.001 to 2.5 molar. The alkaline solution to dry particle ratio on a bone dry basis is between 1:1 and 50:1. The duration of the pretreatment is from 20 minutes to 3 days so long as the particle structure is thoroughly penetrated. After the pretreatment, the alkali solution may be washed from the particles with water or acid although it is not necessary to remove the alkali prior to delignification. The alkaline pretreatment preferably takes place at ambient temperature and pressure. However, temperatures in the range of from about 0° C. to about 80° C. and pressures in the range of from about 1 atm to about 15 atm can be used.

The lignin in the alkali treated lignocellulose material is then oxidized with an acidic oxidizing solution comprising peroxymonosulfate anion in combination with sulfuric acid. In accordance with the invention, the solution has a preferred range of pH, concentration of peroxymonosulfate anion, solution to dry ligocellulose ratio, time of treatment and temperature of treatment as set forth in Table 1 hereinbelow. Also set forth in Table 1 is a broad range of conditions for the acidic oxidizing solution of the invention.

TABLE 1

| Preferred Embodiment | Range of Embodiment |
|---|---|
| pH: −0.1 to 1.8 | −0.3 to 1.99 |
| Weight % $H_2SO_4$ in solution to give pH range: 0.16 to 11 | 20 to 0.1 |
| Weight % of $HSO_5^-$ in solution: 0.5 to 9 | 0.1 to 20 |
| Acidic Solution to Dry Lignocellulose Ratio: 10:1 to 25:1 | 1:1 to 50:1 |
| Time: 0.5 to 290 hours | 0.1 to 600 |
| Temp.: 20° C. to 50° C. | 0° C. to 200° C. |
| Pressure: 1 atm to 10 atm | 1 atm to 15 atm |

Peroxymonosulfate anion may be produced by mixing concentrated solutions of hydrogen peroxide and sulfuric acid to form peroxymonosulfuric acid (Caro's acid) according to Equation 1:

$$H_2SO_4+H_2O_2\rightarrow H_2SO_5+H_2O \qquad \text{(Equation 1)}$$

The lower the amount of water present, the more the equilibrium is shifted to the right, although some sulfuric acid will always be present under normal reaction conditions. Alternatively, peroxymonosulfate may be produced by hydrolysis of peroxydisulfate, according to Equation 2:

$$S_2O_3^{--}+H_2O\rightarrow HSO_5^-+HSO_4^- \qquad \text{(Equation 2)}$$

Peroxymonosulfate may also be obtained by dissolving the commercially available triple salt $2KHSO_5.KHSO_4.K_2SO_4$; (Oxone TM DuPont, Wilmington, Del.).

In all the above methods for providing peroxymonosulfate anion, the anion is in equilibrium with sulfate anion within the ranges set forth in Table 1.

The treatment with the acidic oxidizing liquor results in oxidation of a substantial amount of the lignin in the chips. The oxidized lignin is partially insoluble in water and an alkaline post treatment is required to dissolve the oxidized lignin. After draining the acidic oxidizing liquor from the chips, an alkaline liquor having a pH of at least about 10 is added to the chips. It should be understood that a pH of 10 is a weak alkaline liquor which can be provided within the solubility range of CaO (lime) and is attained at a level of about 0.006 grams/liter of CaO. Any of the alkaline materials described for the alkaline pretreatment step can be used for the post alkaline treatment step. The same conditions of time, temperature, pressure and concentration as are used for the alkaline pretreatment step can be used in the alkaline post treatment step. During the alkaline post treatment step, the alkaline liquor is added to the chips at a liquor to solids level of from about 1:1 to about 50:1. The alkaline post treatment step is conducted at a temperature in the range of from about 0° C. to about 80° C. and a pressure in the range of from about 1 atm to about 10 atm.

Depending on the severity of conditions used during the alkaline pretreatment step, the acidic oxidizing step and alkaline post treatment step, the method of the present invention can be used to provide a chemical pulp with no refiner step or can be used to provide a chemi-mechanical pulp utilizing a refining step.

As indicated above, the use of peroxymonosulfuric acid as a delignifying reagent has been studied recently by Springer, Tappi J., 73 (1):175 (1990)]. This initial work was performed using ground aspen wood as the substrate. Subsequently, chemi-mechanical (cold soda) pulp, high temperature, thermal-refiner mechanical pulp (hardboard fiber) and destructured aspen wood were used as substrates [Minor and Springer, Paper and Timber, 72(10):967–973 (1990)]. These materials were selected to minimize diffusion problems while minimizing fiber damage. The pulps prepared from these substrates had properties that would make them suitable for many fiber products, but their strengths were somewhat less than those of kraft pulps from chips of the same wood species.

In chemical delignification of wood chips, the following sequence of events occurs: (1) the pulping reagent diffuses to the reaction site within the wood chip, (2) the reagent reacts with the lignin, and (3) the reaction products diffuse out of the wood structure into the bulk liquid. If the reaction within the wood structure is rate controlling, the pulping is homogeneous and a uniform pulp is obtained. With most oxidative reagents, the diffusion of the oxidant to the reaction site is rate controlling. The slow water-solution mass transfer rates are even more hindered by the rapid consumption of active oxidant in the outer regions of the chip. Thus, the outer fibers are extensively delignified before the inner core has had an opportunity to react.

If wood chips are pretreated with alkali in accordance with the invention, the subsequent rate of diffusion into and out of the internal wood structure is greatly increased. A much more uniform delignification is thereby achieved. Starting with wood chips, pulps of kraft strength are obtained with very low lignin contents and high yields. These pulps can be easily bleached without use of chlorine-containing reagents.

The following Examples further illustrate various features of the invention.

EXAMPLE 1

Matchstick-shaped samples (40 by 3 by 3 mm) of aspen (*Populus tremuloides*) wood were cut from the bole of mature trees. The length was in the longitudinal axis direction. After determination of moisture content, the remaining samples were stored frozen until used. After thawing, the sticks were individually weighed and placed in individually labeled test tubes. Pretreatment solutions (10 ml) were added to completely cover the sticks. Excess air in the wood was removed with vacuum so that the stick was submerged during pretreatment. Unless stated otherwise, the sticks were rinsed with distilled water until the water was neutral after a 5 minute soak. The water-logged sticks were then treated in the next stage. The pulping liquor was composed of 56 g Oxone TM (2 $KHSO_5.KHSO_4.K_2SO_4$), 20 ml concentrated $H_2SO_4$ and 500 ml water. 10 ml of this solution was added to each stick in a test tube. The pulping stage was performed at controlled temperatures. The other stages were performed at ambient temperatures. The degraded lignin was then extracted with 1% NaOH solution for 24 hours.

Each pulped and extracted stick was placed in a 100 ml beaker with 50 ml water. The loosened fibers were dispersed with a glass rod. The fiber and core fractions were separately solvent-exchanged with acetone and dried in a vacuum oven for the determination of yield, extent of fiberization and lignin content. The perchloric acid catalyzed acetyl bromide method [Iiyama, et al., Wood Sci. and Technol., 22:271 (1988)] was used to measure residual lignin.

Pretreating aspen sticks with alkali significantly improved the speed and uniformity of the peroxymonosulfate pulping reaction compared to that for untreated wood (Table 2).

TABLE 2

Effect of Pretreatment on Peroxymonosulfate Pulping[a] of Aspen

| Pre-treatment | Pulping time (h) | Extent fiberized (%) | Lignin Content (%) | Yield (%) |
|---|---|---|---|---|
| NaOH[b] | 15 | 0 | >15.5 | 76 |
| | 24 | 54 | 6.2 (core)<br>3.6 (fiber) | 68 |
| | 39 | 100 | 4.6 | 63 |
| | 48 | 100 | 2.9 | 62 |
| Water Soak | 48 | 20 | 12.0 (inner core) | 77 |
| | 7.7 | (outer core) | | |
| | | | 1.1 (fiber) | |

[a]Temperature, 21° C.
[b]Ambient temperature, 24 hours; 5% concentration

The pretreated sticks were completely fiberized in <39 hours at room temperature. At 24 hours, even though the pulped stick could be separated into fiber and an unfiberized "core", the difference in lignin contents was not large. By contrast, if the aspen sticks were soaked in water, the pulped sticks were only 20% fiberized after 48 hours and a large gradient of lignin concentration existed between the outer fibers and the inner core.

EXAMPLE 2

Using the treatment procedures used in Example 1, other wood species were also examined (Table 3).

TABLE 3

Effect of Pretreatment on Peroxymonosulfuric Acid Pulping of Various Species

| Species | Pulping time (h) | NaOH pretreatment (%) Yield | Extent Fiberized | Lignin Content | Water Soak (%) Yield | Extent Fiberized | Lignin Content Core | Fiber |
|---|---|---|---|---|---|---|---|---|
| Red Oak | 49 | 55.1 | 100 | 7.1 | 69.3 | 23 | 20 | 9.4 |
| | 140 | 53.7 | 100 | — | 64.1 | 55 | — | — |
| Honey Locust[b] | 24 | — | 100 | 7.5 | — | 0[c] | 16.7 | — |
| Slash Pine | 164 | 59 | 100 | 3.1 | 60 | 100 | — | 5.3 |
| White Pine | 72 | — | —[d] | 15.5 | — | 0 | 19.9 | — |
| | 100 | — | —[d] | 13.7 | — | 0 | 18.3 | — |

[a]Ambient temperature, 24 hours, 5% concentration
[b]1.5 by 1.25 by 50 mm sticks
[c]White outer fibers; most of the stick was hard and dark
[d]Sticks were soft and could be easily fractured but did not seperate into fibers and a core With red oak (*Quercus rubra*), the positive effect of the pretreatment was clearly shown even though the pulping of the pretreated wood was somewhat slower than that of pretreated aspen. After 48 hours at room temperature, the pretreated oak was completely fiberized and had a lignin content of 7.1%. After the same period, the untreated oak was only 23% fiberized, and the lignin content was 9.4% in the fiber and 20% in the core. After 188 hours, the untreated oak sticks still had an unfiberized core. The pretreatment effect was also observed with honey locust (*Gleditsia triacanthos*), a ring-porous hardwood. Because the honey locust samples had a smaller cross-section than those of the other wood species, sodium hydroxide pretreated samples could be pulped in only 24 hours to a lignin content of 7.5%. Water soaked samples were essentially unfiberized and had a lignin content of 16.7% after the same pulping treatment.

The effect was not as clear for the coniferous wood, slash pine (*Pimps elliorrii*). The springwood of this species is more easily penetrated than the dense summerwood, and a "core" is not readily identified. In addition, the variance between different slash pine samples was larger than the difference in the effect between pretreated and water treated samples. Solvent extraction of the resins with ethanol-toluene azeotrope before pretreatment did not change the situation.

White pine (*Pinus strobus*), which has less springwood/summerwood demarcation, was also studied. The penetration of pulping chemicals appeared to be more uniform through white pine than through yellow pine. An uncooked core was not readily definable after pulping, even with the sticks which had not been pretreated with alkali. Possibly this is because of the slower rate of pulping the softwoods relative to hardwoods which allows more time for the reagents to penetrate throughout the wood structure. Delignification is faster in the white pine sticks which had been pretreated with alkali than in those which had not (Table 3).

EXAMPLE 3

Aspen sticks were used to investigate the effects of time, alkali concentration, solvent extraction and reversibility (acid wash after pretreatment) as applicable to the pretreatment (Table 4).

TABLE 4

Effect of Varying Pretreatment Conditions on Pulping[a] of Aspen

| NaOH Concentration (%) | Pretreatment time (h) | Solvent Extration | Acid Washed | Extent Fiberized (%) | Fiber Lignin Content (%) |
|---|---|---|---|---|---|
| 1 | 72 | No | No[b] | 100 | 1.2 |
| 5 | 72 | No | No[b] | 100 | 0.8 |
| 10 | 72 | No | No[b] | 100 | 0.5 |
| 5 | 1 | No | No | 100 | 2.2 |
| 5 | 24 | No | No | 100 | 1.9 |
| 5 | 72 | No | Yes | 100 | 1.2 |
| 5 | 72 | Yes | No | 100 | 1.1 |
| 0 | — | yes | No | 36 | 3.4 |
| 0 | — | No | No | 30 | 3.1 |

[a]Ambient temperature, 48 hour
[b]Extensively washed with water

Over the ranges of variables studied, none of the changes produced a significant difference in the pulping results. Very little difference was observed in the results of changing sodium hydroxide concentration over the range of 1to 10%; however, 1% may be near the minimum necessary. A 5% solution was used for most of the studies. One hour of pretreatment appeared to be sufficient for the 5% concentration. Preextraction of the aspen sticks with methanol and acetone did not have a significant effect on the peroxymonosulfate pulping of either the alkali-pretreated or untreated samples.

EXAMPLE 4

Because peroxymonosulfuric acid is a strong oxidizing agent, the temperatures must be kept low for diffusion to compete with the oxidation reactions. However, if the temperature is too low, the oxidizing times are excessively long. Table 5 shows the results of pulping pretreated aspen sticks at 35° C. and 50° C.

TABLE 5

Effect of Temperature on Peroxymonosulfate Pulping of Pretreated[a] Aspen

| Temp. °C. | Time (h) | Yield (%) | Extent Fiberized (%) | Lignin content (%) |
|---|---|---|---|---|
| 35 | 9 | 69 | (100)[b] | 6.7[c] |
| | 15 | 67 | 100[d] | 5.0 |
| 50 | 6 | — | 53 | 4.0 (fiber) |
| | | | | 9.3 (core) |

[a]Ambient temperature, 24 hours, 5% NaOH
[b]Not easily fiberized (see text)
[c]Inner fibers
[d]Untreated specimens had 5% fiberization At 50° C., the oxidizing reaction was too fast for diffusion, and the outer lignin fibers became oxidized while the inner fibers remained lignified. Pulping was more uniform at 21° C., but it required over 24 hours (Table 2). The optimum temperature to balance diffusion with reaction rate appears to be near 35° C. After 9 hours at that temperature, the stick was soft and it could be fiberized, though not easily. The core was not clearly defined, but the inner fibers were slightly more yellow than the outer fibers and had a slightly higher lignin content. The fiberization point occurred at the same stage of delignification that has been observed for other chemical pulping processes ( 6% to 7% residual lignin).

EXAMPLE 5

Mixed 19 mm long aspen chips (screened only to remove fines, large knots and oversized pieces) 400 g oven-dry basis, 34% moisture were soaked in 3500 ml of 5% NaOH solution overnight. The alkali was removed by filtration and the chips were washed twice with distilled water before treating with a solution composed of 896 g Oxone TM, 320 ml concentrated $H_2SO_4$, and 5 L water. After 50 hours at room temperature, the acidic pulping liquors were removed, and the chips were washed twice with water and extracted for 24 hours at ambient temperature with 4 L of 1% NaOH solution. The alkali was removed by filtration, and the softened chips were washed with hot water and fiberized with a large excess of hot water in a vigorously stirred mixing tank. Red oak and red alder chips were similarly pulped.

Handsheets were formed and tested by TAPPI Test Methods T205 om-88 and T220 om-88. Tensile indices were performed on "necked-down" specimens and calculated on a volume basis. Viscosities were determined by Tappi Test Method T230 om-82.

Because of the increased penetration achievable with an alkaline pretreatment, direct pulping of wood chips is feasible. The results are shown in Table 6.

TABLE 6

Results of Chip Pulping with Peroxymonosulfuric Acid

| Species | Total Yield (%) | Screenings (%) | Viscosity (mPa-s) | Lignin Content (%) | Canadian standard freeness (ml) | Tear index (mN-m²/g) | Tensile index (N-m/g) | Brightness (%) |
|---|---|---|---|---|---|---|---|---|
| Aspen A | 64.2 | 14.8 | 28 | 0.8 | 665 | 7.7 | 93 | — |
| | | | | | 485 | 6.5 | 119 | — |
| | | | | | 325 | 6.4 | 128 | — |
| Aspen B | 58.4 | 2.7 | 48 | 0.4 | 680 | 5.7 | 77 | 74 |
| | | | | | 565 | 6.2 | 88 | — |
| | | | | | 370 | 6.1 | 94 | — |
| Aspen, no pretreatment | 76.1 | 64.2 | 47 | — | — | — | — | — |
| Aspen Kraft[a] | 52.5 | — | — | 2.5 | 615 | 6.2 | 52 | 33 |
| | | | | | 505 | 7.6 | 64 | — |
| | | | | | 370 | 8.6 | 88 | — |
| Red Oak | 46.8 | 14.7 | 43 | 1.0 | 710 | 8.8 | 46 | — |
| | | | | | 550 | 11.1 | 72 | — |
| | | | | | 395 | 10.2 | 88 | — |

TABLE 6-continued

| Species | Total Yield (%) | Screenings (%) | Viscosity (mPa-s) | Lignin Content (%) | Canadian standard freeness (ml) | Tear index (mN-m²/g) | Tensile index (N-m/g) | Brightness (%) |
|---|---|---|---|---|---|---|---|---|
| | Results of Chip Pulping with Peroxymonosulfuric Acid | | | | | | | |
| Red Alder | 53.1 | 18 | 29 | 1.1 | 725 | 5.1 | 27 | — |
| | | | | | 525 | 7.5 | 85 | — |
| | | | | | 430 | 6.7 | 97 | — |
| Bleached Aspen B | — | — | 56 | — | 660 | 5.6 | 28 | 85 |
| | | | | | 505 | 8.1 | 82 | — |
| | | | | | 380 | 7.1 | 97 | — |

*Chips for kraft pulping taken from same sample as chips for peroxymonosulfuric acid pulping In 50 hours at room temperature, alkali-pretreated 19 mm (0.75 in.) aspen chips could be pulped with acidic peroxymonosulfate to a lignin content of 0.4% with 2.7% screenings and a total yield of 58.4%. Handsheet tear-tensile indices were comparable to those of aspen kraft pulps from chips. High-strength pulps were also prepared from red oak and red alder (*Alnus rubra*) chips. The low-lignin aspen pulp was very easily bleached with 0.5% alkaline hydrogen peroxide.

EXAMPLE 6

Aspen hardboard fiber was soaked for 16 hours in a 1.0% solution of sodium hydroxide at 10% consistency and then drained. The fiber was then delignified at room temperature (22° C.) for 3 days using a 2.7% solution of peroxymonosulfuric acid acidified to pH 0.30 with sulfuric acid at 10% consistency. An untreated sample was also delignified under identical conditions. The sodium hydroxide left in the drained fibers was neutralized by adding an equivalent amount of sulfuric acid to the peroxymonosulfuric acid treating solution. To remove the degraded lignin, both samples were extracted with 1.0% NaOH at 50° C. for 3 hours.

TABLE 7

Effect of Alkali Pretreatment on Delignification of Aspen Hardboard Fiber.

| Pretreatment | Residue yield (%) | Lignin content (%) |
|---|---|---|
| None | 63 | 8.0 |
| NaOH | 61 | 4.1 |

Table 7 shows that the NaOH pretreated fiber was more easily delignified than the untreated fiber. The alkaline pretreatment opens up the fiber cell wall and thus increases the rate of diffusion across it.

SUMMARY

Pretreatment of hardwood chips or sticks or fiber with alkali increased the permeability of the wood and increased the rate of diffusion of water-soluble materials. This treatment can be used before pulping with acidic, oxidative reagents such as peroxymonosulfuric acid to increase the homogeneity and overall rate of pulping. Penetration into the wood macrostructure and through the micropores of the fiber cell wall are both improved. With this pretreatment, a preliminary fiberization step is not necessary, and strong pulps can be obtained directly from chips.

It is probable that the mechanism of improved pulping reagent penetration is a cleavage of ester bonds as proposed by Tarkow, et al., Advances in Chemistry, Series No. 95, American Chemical Society, p. 197, (1969). The 4-O-methyl glucuronic acids of hardwood xylans may be forming ester cross-links with other wood polymers, which, when broken, allow the wood structure to swell beyond the water-swollen state. Penetration into the wood macrostructure and through the micropores of the fiber cell walls are both improved. The middle lamella structure seems to be weakened by alkali pretreatment which implicates the galacturonic acids of pectin and other pectic polysaccharides that are present in those intercellular regions as possible cross-linking acids. Some of the carboxylic acid portion of the esters may also be in the lignin polymer.

What is claimed is:

1. A process for pulping wood chips comprising the steps of:

(a) contacting wood chips with a first alkaline liquor wherein said contact takes place at a temperature of from about 0° C. to about 80° C. and at a pressure in the range of from about 1 atm to about 15 atm;

(b) maintaining said wood chips in contact with said alkaline liquors for a period of time sufficient to permit swelling of said wood chips wherein the wood structure becomes sufficiently permeable to allow the passage of an acidic oxidizing liquor and wherein the pH of said oxidizing liquor is between −0.3 and 1.99;

(c) contacting said alkaline swollen wood chips with an acidic oxidizing liquor comprising peroxymonosulfate anion;

(d) maintaining said wood chips in contact with said acidic oxidizing liquor for a time sufficient to oxidize a substantial amount of the lignin of said wood chips, wherein said contact with said acidic oxidizing liquor takes place at a temperature of from about 0° C. to about 50° C., at a pressure of from about 1 atm to about 15 atm, and for a time period of from about 0.5 hours to about 290 hours; and (e) contacting said acid treated wood chips with a second alkaline liquor for a period of time of from about 0.3 hours to about 72 hours at a temperature of from about 0° C. to about 80° C. and at a pressure of from about 1 atm to about 10 atm which is sufficient to solubilize and extract said oxidized lignin, wherein said alkaline treated wood chips are sufficiently fiberized to produce a pulp that does not require subsequent mechanical refiner step.

2. A process in accordance with claim 1 wherein said alkali in said first alkaline liquor is present at a level in the range of from about 0.001 to about 2.5 molar.

3. A process in accordance with claim 1 wherein said first alkali liquor to wood chips ratio on a dry basis is between 1:1 and 50:1.

4. A process in accordance with claim 1 wherein said wood chips is maintained in said first alkaline liquor for a period of from about 20 minutes to about 3 days.

5. A process in accordance with claim 1 wherein said acidic oxidizing liquor has peroxymonosulfate anion present at a level of from about 0.1% to about 20% by weight.

6. A process in accordance with claim 1 wherein said acidic oxidizing liquor has peroxymonosulfate anion present at a level of from about 0.5% to about 9% by weight.

7. A process in accordance with claim 1 wherein said acidic oxidizing liquor is present at a weight:weight ratio to wood chips of from about 1:1 to about 50:1.

8. A process in accordance with claim 1 wherein said acidic oxidizing liquor is present at a weight:weight ratio to wood chips of from about 10:1 to about 25:1.

9. A process in accordance with claim 1 wherein the pH of said acidic oxidizing liquor being from about −0.1 to 1.8.

10. A process in accordance with claim 1 wherein said contact with said acidic oxidizing liquor takes place at a temperature of from about 20° C. to about 50° C. and at a pressure of from about 1 atm to about 10 atm.

11. A process in accordance with claim 1 wherein the pH of said first alkaline liquor is above pH 11.

12. A process in accordance with claim 1 wherein the pH of said second alkaline liquor is above pH 10.

13. A process in accordance with claim 1 wherein the alkaline material used in said first alkaline liquor and said second alkaline liquor is selected from the group consisting of alkali metal and alkaline earth metal hydroxides, ammonium hydroxide and organic bases.

14. A process in accordance with claim 1 wherein said alkaline material used for said first alkaline liquor and said second alkaline liquor is sodium hydroxide.

* * * * *